United States Patent [19]

Abbott et al.

[11] 4,320,915

[45] Mar. 23, 1982

[54] INTERNAL ELEVATOR

[75] Inventors: Roderick K. Abbott, Villa Park; Padmasiri D. Seneviratne, Fullerton; Daniel P. Juhasz, Westminster, all of Calif.

[73] Assignee: Varco International, Inc., Orange, Calif.

[21] Appl. No.: 133,501

[22] Filed: Mar. 24, 1980

[51] Int. Cl.[3] ..... B66C 1/56

[52] U.S. Cl. ..... 294/96; 294/86.15; 294/86.25; 414/626

[58] Field of Search ..... 294/67 A, 67 AA, 86.1, 294/86.15, 86.24, 86.25, 86.3, 86.31, 88, 93–97, 103 CG; 414/626, 684, 911; 405/158, 169, 170, 227, 232

[56] References Cited

U.S. PATENT DOCUMENTS

| | | | |
|---|---|---|---|
| 1,231,262 | 6/1917 | Katchmazenski | 294/96 X |
| 1,445,581 | 2/1923 | Fullop | 294/86.24 X |
| 1,508,417 | 9/1924 | Spitler | 294/86.25 X |
| 1,712,898 | 5/1929 | Newkirk | 294/86.15 |
| 1,776,989 | 9/1930 | Baimbridge et al. | 294/86.25 X |
| 2,752,191 | 6/1956 | Pierce | 294/93 |
| 3,265,431 | 8/1966 | Burner | 294/86.25 |
| 4,050,731 | 9/1977 | Coone et al. | 294/86.24 |
| 4,235,469 | 11/1980 | Denny et al. | 294/86.25 X |

*Primary Examiner*—Johnny D. Cherry

*Attorney, Agent, or Firm*—William P. Green

[57] ABSTRACT

An internal elevator to be received within and internally grip and support a tubular member such as a well platform supporting pile, and including slips preferably mounted within openings in an outer body and actuable radially outwardly into gripping engagement with the tubular member by powered axial movement of an inner camming body. The elevator is desirably suspended in horizontal position by a hanger in a manner enabling the elevator to be stabbed into an end of a horizontal tubular pile or member, with the elevator having additional connector means attachable to a suspending line in a relation then swinging the elevator and pile to vertical positions. In one form of the invention, the elevator may be formed as part of an elongated structure adapted to be lowered through vertically spaced pile guides, with the elongated structure acting to bridge the space between the guides and thereby assure proper alignment of the elevator with the guides and with a pile centered with respect thereto.

16 Claims, 11 Drawing Figures

FIG. 4
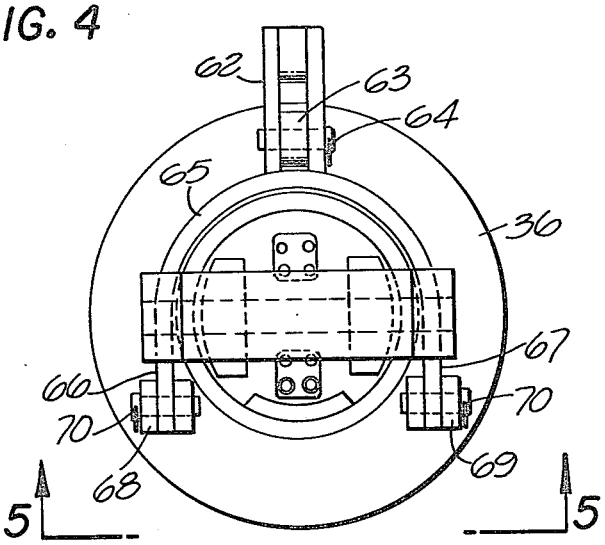
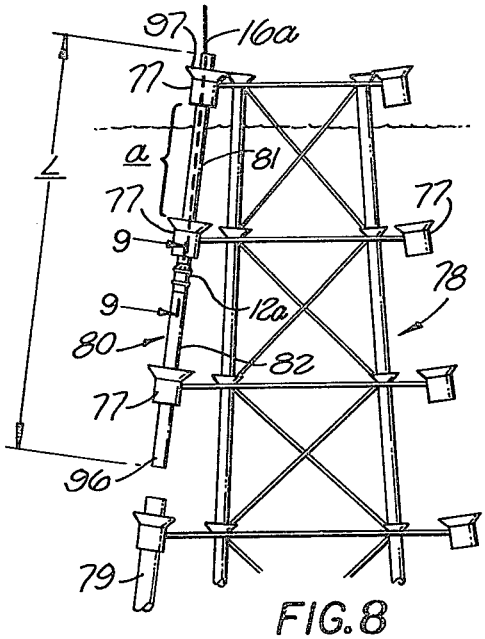
FIG. 8
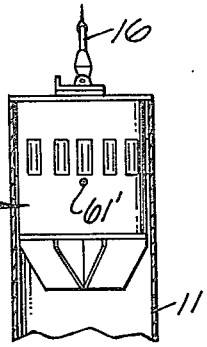
FIG. 7
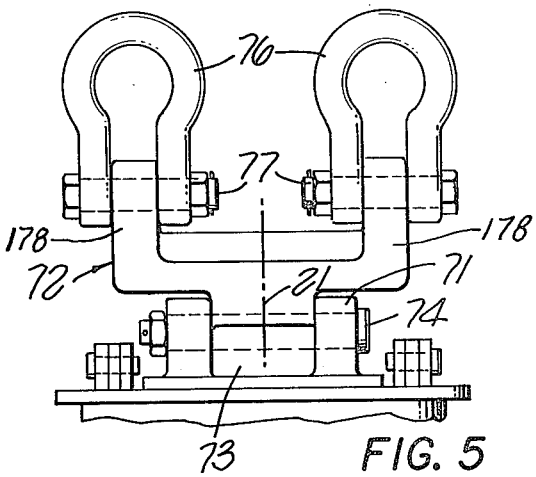
FIG. 5
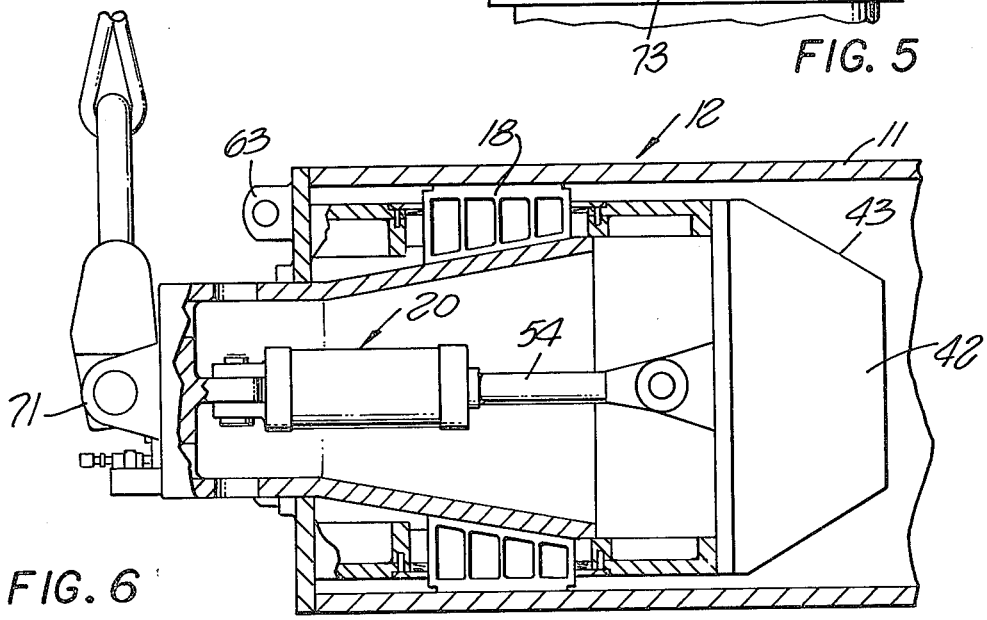
FIG. 6

INTERNAL ELEVATOR

BACKGROUND OF THE INVENTION

This invention relates to improved elevators for gripping and suspending a tubular member, such as a pile for locating an offshore well drilling platform.

In moving a series of piles into position for locating an offshore drilling platform, the piles are normally suspended individually by a crane mounted on a barge adjacent the drilling site, with an elevator device gripping the upper end of the pile and connected to a line from the crane. In order to enable a conventional elevator to effectively grip and lift the piles, it is usually necessary for the piles to first be moved in some manner to vertically extending positions on the barge. Also, most elevators have been of an external type, which must be received about the outside of the upper end of each pile, with the resultant further requirement that the vertical piles be spaced laterally apart to allow proper contacting of the elevator with their upper ends.

SUMMARY OF THE INVENTION

The present invention provides an internal elevator which is adapted to be received within the end of a pile or other tubular member being handled, and to grip the pile internally without the necessity for reception about the outside of the pile. Further, the elevator is so constructed that it can be stabbed into the end of a pile or other tubular member while that member is in horizontally extending condition, to thus avoid the necessity for initial placement of the pile in a vertical position as discussed above. Thus, a series of piles may be stacked horizontally on a barge, in direct contact with one another and without the necessity for maintenance of their pickup ends in spaced relation, and the piles may then be individually lifted from the stack, swung to vertical positions, and moved in that vertical position to a desired location of use. During initial stabbing of the elevator into a horizontal pile, the elevator is preferably suspended by a hanger which supports the elevator in horizontal position and is constructed to avoid interference by the hanger with movement of the horizontal elevator into an end of the pile. For this purpose, the hanger may have a support arm extending generally horizontally along the upper side of the pile as the elevator is stabbed thereinto. After the elevator has been stabbed into and actuated to grip the horizontal pile, a second connector structure on the hanger, other than the discussed arm, may be attached to a suspension line and utilized to lift the elevator and pile to a vertical position.

The elevator preferably has slips which are actuable radially outwardly against the interior of the pile or other tubular member to be lifted, with the slips desirably being mounted within openings in an outer body of the elevator and guided by those openings for radially inward and outward movement relative thereto. An inner body is mounted within the outer body for relative axial movement and has a camming surface engageable with the slips to actuate them radially outwardly into gripping engagement with the pile. The two bodies are moved axially relative to one another by power operated means, preferably taking the form of a piston and cylinder mechanism located within and extending axially of the inner body. A tapered stabbing projection may be provided at one end of the outer body of the elevator, and a stop flange or shoulder may be provided at its opposite end for engagement with the end of the pile to limit insertion of the elevator into the pile.

In a modified arrangement, the elevator is connectable to a pair of elongated tubes projecting in opposite directions therefrom and acting to bridge the distance between two spaced pile guides to facilitate maintenance of proper alignment of the elevator with those guides and with a pile as the elevator is lowered to a position for removing a pile from the platform structure.

BRIEF DESCRIPTION OF THE DRAWINGS

The above and other features and objects of the invention will be better understood from the following detailed description of the typical embodiments illustrated in the accompanying drawings, in which:

FIG. 4 is a front or outer end view of the elevator, taken on line 4—4 of FIG. 3 and with the shackles for attachment to a suspending line being deleted for clarity of illustration;

FIG. 5 is a fragmentary bottom view of the outer end of the elevator, taken on line 5—5 of FIG. 4;

FIG. 6 is a view similar to FIG. 3, but showing the elevator in its gripping condition;

FIG. 7 is a fragmentary view representing the elevator and the upper end of a suspended tubular pile in vertical condition;

FIG. 8 illustrates a variational form of elevator as it appears in use when being inserted downwardly through a series of aligned pile guides to grip and withdraw upwardly a previously installed follower pile;

DESCRIPTION OF THE PREFERRED EMBODIMENTS

Figure 1:
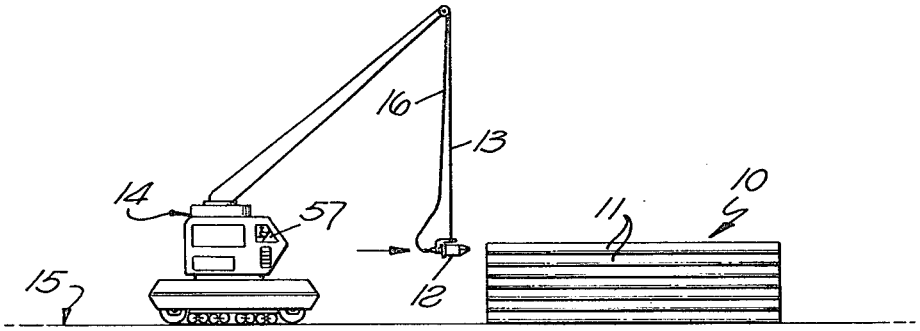
FIG. 1 is a diagrammatic representation of an internal elevator constructed in accordance with the invention as it is being stabbed into the end of a horizontally extending tubular pile or other tubular member to be lifted by the elevator.
Figure 2:
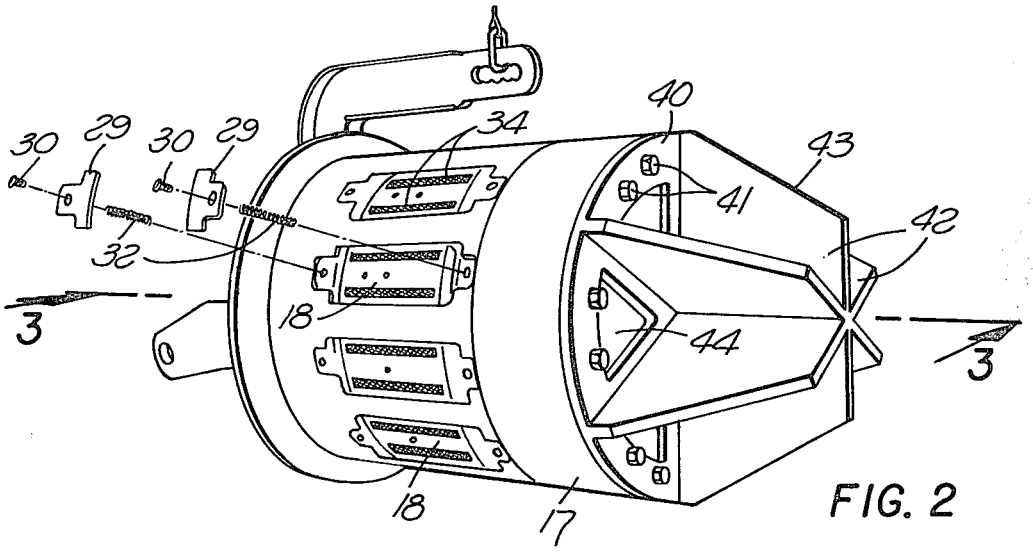
FIG. 2 is a perspective view of the elevator of FIG. 1 in horizontal condition.

In FIG. 1, there is represented at 10 a stack of horizontally extending tubular piles or other tubular members or pipes which are to be lifted from the stack individually and suspended in vertically extending condition, and which may then typically be lowered through pile guides of an offshore drilling platform to anchor that platform to the ocean floor. The piles 11 are engaged internally and supported by an internal elevator 12 constructed in accordance with the invention, which elevator is in FIG. 1 suspended by the auxiliary fall or line 13 of a crane 14 which may be supported on a barge 15 adjacent the stack of piles 11. The main fall or line 16 of the crane is subsequently used to suspend the elevator 12 and a carried one of the piles 11 in vertical position.

Figure 3:
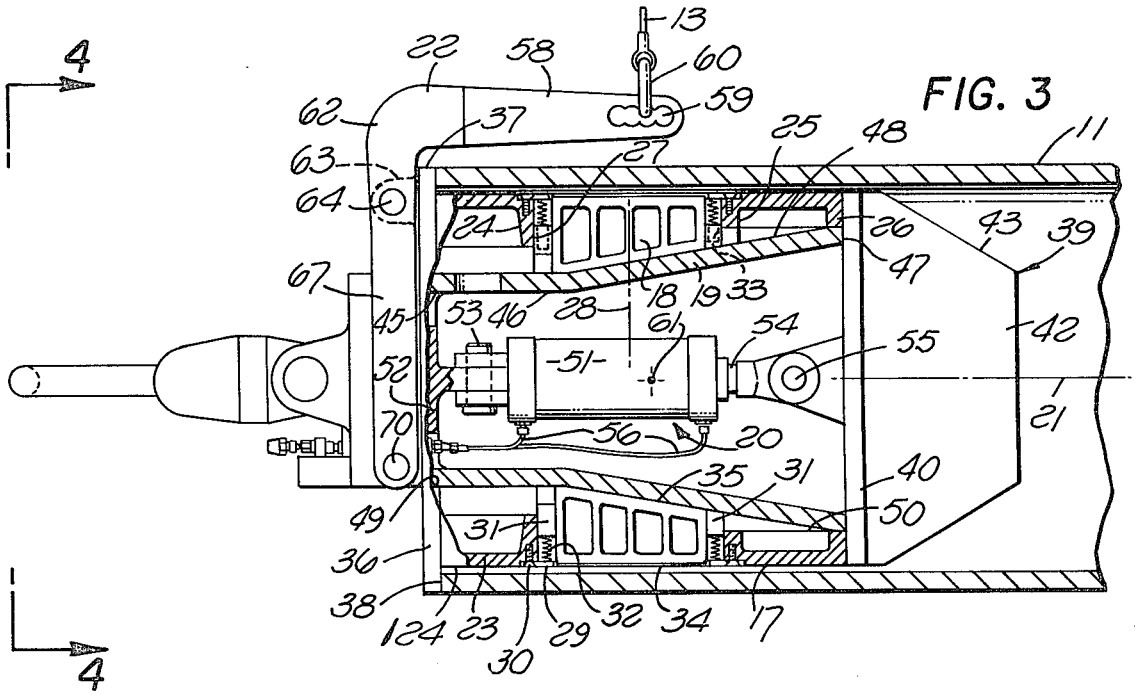
FIG. 3 is a central vertical section taken on line 3—3 of FIG. 2.

FIG. 3 illustrates the internal elevator after it has been inserted horizontally into an end of one of the piles 11, and before the elevator has been actuated to grip the pile. As seen in FIG. 3, the elevator 12 includes an outer tubular body 17 movably carrying a series of circularly spaced internal slips 18, and an inner body 19 actuated relative to the outer body by a piston and cylinder mechanism 20, with all of these parts in the positions of FIGS. 1 to 6 being centered about the horizontal axis 21 of the pile 11 which is to be lifted. The device is suspended from line 13 in the FIGS. 1 to 6 horizontal position by a hanger 22 constructed to support the elevator in balanced condition while horizontal.

The outer body 17 has a cylindrical outer wall 23 centered about axis 21 and having an outer straight cylindrical surface 124 of a diameter just slightly smaller than the internal diameter of pipe 11, to fit closely therein. The wall may be strengthened by provision of annular radially inwardly projecting ribs or webs 24, 25 and 26. Axially between the two flanges 24 and 25, outer body 17 has a series of circularly spaced essentially rectangular axially elongated openings 27 extending through the entire radial thickness of outer body 17. The slips 18 are shaped to fit closely within openings 27, and are guided by the openings and by flanges 24 and 25 for sliding movement relative to outer body 17 directly radially of axis 21 of the elevator. The confinement of the slips within the apertures prevents any movement of the slips other than such radial movement. For example, in FIG. 3, the two slips there illustrated are movable relative to body 17 along axis 28 which extends perpendicular to and intersects main axis 21 of the elevator. The radially outward movement of the slips is limited by a pair of retaining elements or plates 29 secured to the outer surface of body 17 by screws 30 and projecting to positions directly radially outwardly of end portions 31 of the slips. Two pairs of coil springs 32 are received within radially extending outwardly opening recesses 33 in the end portions 31 of the slips, and bear radially outwardly against the retaining plates 29, to at all times yieldingly urge the slips radially inwardly within their locating openings 27 and into engagement with inner camming body 19.

The slips have radially outer gripping faces or gripping dies 34 lying in a cylindrical plane about axis 21 for gripping engagement with the inner surface of pile 11. The radially inner surfaces 35 of the slips are disposed at an oblique camming angle with respect to axis 21 to be cammed outwardly by inner body 19. At its left end as viewed in FIG. 3, outer body 17 has a tranverse end wall 36 which may be formed as a circular plate disposed perpendicular to axis 21 of the elevator and welded to body 17. The peripheral edge 37 of end plate 36 projects radially outwardly beyond the outer surface 124 of the side wall 23 of body 17, to form an annular transverse flange or shoulder engageable annularly against the end edge 38 of pile 11 to limit movement of the internal elevator into the pile in the FIG. 3 position.

At its right or inner end as viewed in FIG. 3, the outer body 17 carries a tapered stabbing projection 39, which may include a rigid end plate 40 peripherally secured by bolts 41 or otherwise to end flange 26 of the main portion of outer body 17. The stabbing projection 39 also includes a series of radially extending fins or webs 42, which may be welded to plate 40 and have outer edges 43 converging at an oblique angle toward axis 21 as those edges advance axially inwardly or rightwardly as seen in FIG. 3. Edges 43 thus give the structure 39 in effect an axially inwardly tapering configuration, by virtue of which edges 43 may contact edge 38 of pile 11 as the elevator is inserted into the pile, to center the elevator within the pile during a stabbing operation. Circularly between fins 42, the plate 40 may contain a series of circularly spaced sector-shaped openings 44, through which water may pass when the elevator is moved vertically through a body of water.

Inner body 19 is tubular and centered about axis 21, and may have a straight cylindrical side wall between the locations 45 and 46 of FIG. 3, and an annular frustoconically flaring side wall from the location 46 to the end edge 47 in FIG. 3. The angle of flare of the outer annular surface 48 between the locations 46 and 47 corresponds to the angularity of the inner surfaces 35 of slips 18, to effectively cam the slips radially outwardly by virtue of the interengagement of the camming surfaces 35 and 48 when inner body 19 is moved leftwardly between the FIG. 3 and FIG. 6 positions. At its left end, the straight cylindrical portion of inner body 19 extends through and is a close fit within a circular opening 49 in end wall 36 of the outer body, to locate and guide the inner body for movement along axis 21 relative to the outer body. The enlarged diameter right end of body 19 slidably engages axially extending guide surfaces 50 formed in outer body 17, to locate and guide the inner body at that location, and thereby prevent any movement of the inner body relative to the outer body other than the described axially sliding movement.

The inner body is power actuated axially relative to the outer body by the piston and cylinder mechanism 20, whose cylinder 51 is attached to the transverse end wall 52 of inner body 19 at 53, and whose piston has its rod 54 connected at 55 to axially inner end plate 40 of the outer body. Hydraulic fluid under pressure can be admitted to either end of cylinder 51 selectively, and discharged from the opposite end, through fluid lines 56 extending through the outer end wall of body 17 and extending to a pressure fluid source and valve assembly 57 (FIG. 1) located in the cab of crane 14. The inner body may thus be power actuated in either direction relative to the outer body between the positions of FIGS. 3 and 6.

Hanger 22 for suspending the elevator in its horizontal stabbing position is connected at the left or axially outer end to body 17, and has an arm 58 which projects horizontally and axially inwardly with respect to the elevator at a location spaced above the top of outer body 17 as seen in FIG. 3. At its right end as viewed in FIG. 3, arm 58 contains an opening or series of openings 59 connectable to a suspending link or hook 60 at the end of line 13 to support arm 58 from that line. The opening 59 and point of connection or hook or link 60 to arm 58 are desirably located directly above and in vertical alignment with the center of gravity 61 of the entire elevator when the elevator is in its FIG. 3 horizontal condition. As a result, the elevator when suspended from line 13 at the location of opening 59 will automatically hang in the illustrated horizontal position, and will be balanced in that condition, thus enabling the elevator to be stabbed horizontally into the end of horizontal pile 11.

Arm 58 is secured rigidly to outer body 17 by shaping hanger 22 to have a downwardly extending bifurcated portion 62 received at opposite sides of a connecting lug 63 projecting from end plate 36 and secured thereto by a pin 64 extending through registering apertures in the two halves of portion 62 and in lug 63. Downwardly beyond its portion 62, hanger 22 forms a yoke 65 whose two arms 66 and 67 (FIG. 4) curve downwardly and connect terminally to lugs 68 and 69 projecting from end plate 36. Yoke arms 66 and 67 are secured to lugs 68 and 69 by pins 70. When pins 64 and 70 are in position as illustrated in FIG. 4, the arm 22 is rigidly retained in fixed position relative to outer body 17 of the elevator. The pins 64 and 70 can all be easily removed from their positions of reception within registering openings in the connected parts, to allow complete detachment of hanger 22 when desired in order to avoid interference by its offset arm 58 with lowering of the elevator downwardly through pile guides in a well drilling offshore platform or the like.

The connection of the main suspension line 16 of the crane to the elevator is made by attachment of that line to the inner body 19 of the elevator. More particularly, as seen in FIGS. 4 to 6, the transverse end wall 52 of inner body 19 preferably forms at its axially outer side a pair of spaced connector lugs 71, centered with respect to the main axis 21 of the elevator and located at opposite sides thereof and equal distances therefrom. A yoke 72 (FIG. 5) has a portion 73 received between the two lugs 71 and pivotally secured thereto by a bolt 74, and has arms 178 which are symmetrical with respect to axis 21 and are pivotally attached to a pair of shackles 76 connectable to the main suspension line 16 of the crane. Yoke 72 and shackles 76 can swing relative to the elevator between the position illustrated in FIG. 6 and the vertical suspension position illustrated in FIG. 7. In the FIG. 7 condition, the center of gravity 61′ of the vertical elevator is on axis 21 of the elevator and directly vertically beneath and in vertical alignment with a line 16 suspending the tool and connected to yoke 72. Thus, in the FIG. 7 condition, the elevator and a supported pile hang directly vertically downwardly in alignment with line 16.

To describe briefly a cycle of use of the elevator of FIGS. 1 to 7, assume that the pile 11 which is to be lifted is initially in the horizontal position of FIG. 1, and that the elevator is suspended from line 13 through hanger 22, with the axis 21 of the elevator disposed directly horizontally by virtue of the positioning of the point of connection of hanger 22 to line 13 directly above the center of gravity 61. With the elevator suspended in this condition, and with the slips retracted, the crane is actuated to move line 13 and the suspended elevator 12 rightwardly in FIG. 1, and into the open end of a pile 11, to the fully inserted position of FIG. 3. When the elevator is in that condition, the operator actuates unit 57 in the cab of the crane to cause piston and cylinder mechanism 20 to actuate inner body 19 leftwardly to its FIG. 6 position, thus forcing the slips 18 radially outwardly against the inner surface of pile 11 and into tight gripping engagement therewith. In that condition, the slips can effectively support the entire weight of the pile.

With the slips thus retained in their gripping condition, the crane operator slacks off on auxiliary suspension line 13, and if desired hanger 22 may be detached from the elevator as represented in FIG. 6. The operator then causes the crane to exert an upward pulling force on main line 16 of the crane, connected to yoke 72 through shackles 76, which force causes line 16 to swing yoke 72 and shackles 76 upwardly about the axis of pin 74 to the FIG. 6 vertical condition, following which further upward force exerted by line 16 pulls the line and the elevator upwardly, swinging the left end of the pile upwardly and ultimately lifting the entire pile in vertical condition as represented in FIG. 7. The crane may then be actuated to move the suspended vertical pile to any desired location, and lower it through pile guides or to any other desired active position. After that pile has been appropriately located, the piston and cylinder mechanism 20 may be actuated to retract the slips and permit removal of the elevator from the pile, and the elevator may be returned to its horizontal condition, stabbed into another pile, and used to lift that pile and sequentially any number of other piles from a stack 10 from horizontal to vertical position as discussed.

FIGS. 8 through 11 show a variational arrangement which is utilized for removing follower piles from within the pile guides 77 of a 'jacket' 78 of an offshore platform. As seen in FIG. 8, the jacket 78 is assumed to have several series of the pile guides 77, with successive guides in each of the series being spaced vertically apart a distance such as that represented at a. During the attachment of anchoring jacket 78 to the ocean floor, a series of piles are successively driven downwardly through guides 77 and into the ocean floor. After completion of the driving operation, the 'follower' piles above a certain level are normally removed from the jacket. In FIG. 8, one such follower pile is represented at 79, and may be a tubular or pipe-like element such as that illustrated at 11 in FIGS. 1 to 7.

In order to remove the pile 79, I utilize an elongated assembly or structure 80, consisting of an internal elevator 12*a* similar to elevator 12 of the first form of the invention and connected between two elongated rigid aligned tubes or pipes 81 and 82. These pipes 81 and 82 are of an external diameter corresponding approximately to the external diameter of the outer body 17*a* of elevator 12*a*, and are dimensioned to be received within pile 79 in closely fitting relation. The overall length L of the assembly 80, including elevator 12*a* and the two pipes or tubes 81 and 82, is at least long enough to enable the assembly to be received simultaneously within two spaced ones of the tubular pile guides 77, and preferably is long enough to assure that as the assembly 80 is inserted downwardly through guides 77 the assembly 80 will at all times be received within at least two of the guides, to thereby be held effectively in a properly aligned position with respect to the guides and pile 79 by such bridging engagement with two guides.

Figure 9:
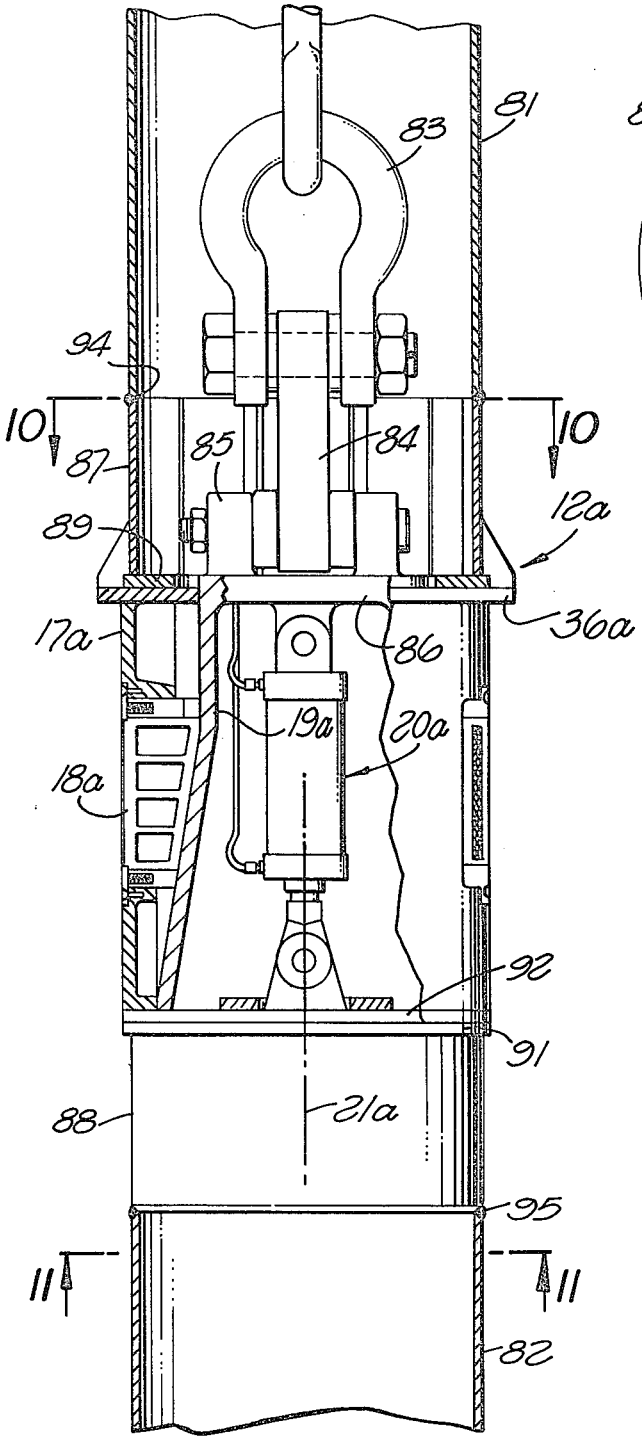
FIG. 9 is an enlarged fragmentary axial section taken on line 9—9 of FIG. 8.
Figure 10:
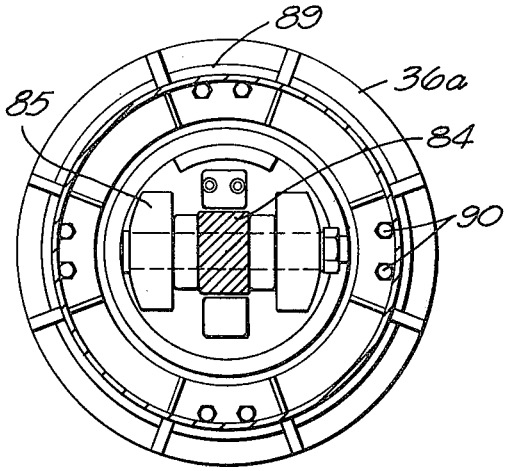
FIGS. 10 and 11 are opposite end views of the elevator of FIGS. 8 and 9, taken on lines 10—10 and 11—11 respectively of FIG. 9.

As will be apparent from FIG. 9, the outer and inner bodies 17*a* and 19*a* of elevator 12*a* are in most respects essentially the same as the corresponding bodies 17 and 19 of FIGS. 1 to 7, with the inner body being actuable axially in opposite directions by piston and cylinder mechanism 20*a* corresponding to mechanism 20 of the first form of the invention, and acting to cam slips 18*a* outwardly into gripping engagement with the surrounding pile when the inner body is moved axially relative to the outer body. The suspension line 16*a* from the crane extends downwardly through the upper extension pipe 81 and connects to a shackle 83 secured by a link 84 to lugs 85 projecting from end wall 86 of inner body 19*a* of the elevator. The device of FIGS. 8 to 11 does not utilize the offset hanger 22 for suspending the elevator in horizontal condition.

Figure 11:
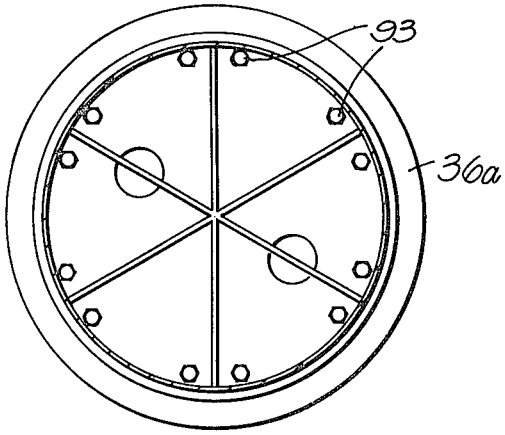

In order to enable attachment of pipes 81 and 82 to the opposite ends of outer body 17*a* of the elevator, two short attaching tubes 87 and 88 are rigidly secured to body 17*a*. Tube 87 may for example be welded annularly to a rigid ring 89 which may in turn be secured by bolts 90 (FIG. 10) to end plate 36*a* of the outer body (corresponding to plate 36 of FIGS. 1 to 7). At the opposite end of body 17*a*, a transverse plate 91 may be welded annularly to tube 88, and be rigidly secured to a transverse end wall 92 of body 17*a* by bolts 93 (FIG. 11). When the elevator of FIGS. 8 to 11 is to be utilized in the manner illustrated in FIG. 8, the tube 81 is welded annularly to tube 87 at 94, and the tube 82 is welded annularly to tube 88 at 95, with the tubes 81 and 82 being aligned with one another and centered about the main axis 21*a* of the elevator. Each of the two tubes 81 and 82 should of course be longer axially than the elevator 12*a*, and in most instances has an axial length at least several times that of the elevator to bridge the space between the different guides 77 as discussed.

In using the unit 80 in the manner illustrated in FIG. 8, line 16*a* is first connected to shackle 83, and the crane is then actuated to lower the elongated structure 80 in generally vertical condition at the lower end of line 16*a*, and first to a position in which the bottom end 96 of structure 80 contacts the upper one of a series of vertically spaced pile guides. As the structure 80 is lowered relative to that guide, the upper funnel-shaped tapering portion 97 of the guide centers the lower end 96 of structure 80, to direct that structure downwardly through the guide. Further lowering of structure 80 will ultimately bring it into engagement with a second of the pile guides, to thereby effectively align structure 80 with respect to the guides. The structure 80 is lowered through an aligned series of the guides 77 until the lower end 96 reaches the upper end of the pile 79 which is to be removed from the jacket. Because structure 80 is long enough to assure its reception at all times within at least two of the guides 77, the lower end of structure 80 will automatically be aligned with and move downwardly into the upper end of pile 79. The lowering action is continued until the periphery of end plate 36*a* of elevator 12*a* engages the upper end of pile 79 to prevent further lowering of the elevator. The operator then hydraulically actuates the piston and cylinder mechanism 20*a* to cause slips 18*a* to internally grip the upper end of pile 79, so that the pile may then be pulled upwardly by exerting upward force on line 16*a* and the connected elevator 12*a*. After pile 79 has been removed in this manner, it may be detached from line 16*a* and structure 80 by releasing elevator 12*a*, and the structure 80 may then be lowered again through the same guides and into the upper end of the next successive and lower pile, so that elevator 12*a* may expand outwardly against and grip that pile and remove it upwardly. As many follower piles as are desired may be sequentially withdrawn from the jacket in this manner.

While certain specific embodiments of the present invention have been disclosed as typical, the invention is of course not limited to these particular forms, but rather is applicable broadly to all such variations as fall within the scope of the appended claims.

We claim:

1. The combination comprising:

an internal elevator for lifting a tubular member; and an offset hanger for suspending the elevator from a suppporting line in a horizontal position in which the elevator can be stabbed horizontally into an end of said tubular member when the tubular member is in a horizontal position; said elevator comprising:

an outer body adapted to be received within said tubular member and having an essentially tubular sidewall containing openings;

a plurality of slips mounted within said openings in said body and guided thereby for only radially inward and outward movement within said openings and relative to said body and having radially outer gripping faces engageable outwardly against said tubular member to grip and support it;

an essentially tubular inner body within said outer body having an essentially annular flaring portion and having a connection adapted to be attached to a supporting element in a manner suspending said inner body therefrom;

said flaring portion of said inner body and said slips having engaging camming surfaces acting upon axial movement of said inner body relative to the slips to cam said slips radially outwardly against the tubular member;

power actuated means for moving said inner body axially relative to said outer body and slips;

said power actuated means including a piston and cylinder mechanism extending essentially axially within said inner body and having its piston and cylinder connected to said two bodies respectively to power actuate the inner body axially relative to the outer body;

a tapering stabbing projection carried by said outer body at an axially inner end thereof; and connector means attached to the outer body at an outer end thereof and centered with respect to the elevator in a relation to suspend the elevator and a carried tubular member in a vertical position from a suspending line.

2. The combination as recited in claim 1, in which said outer body has an annular radially outwardly projecting flange at an outer end thereof forming a shoulder engageable with an end of a tubular member to limit insertion of the elevator thereinto, said elevator including spring means yieldingly urging said slips radially inwardly.

3. The combination as recited in claim 1, in which said elevator when in said horizontal position has its center of gravity located for reception within said tubular member in its horizontal position; said hanger extending in an axially inward direction above the elevator and above said tubular member into which the elevator projects and being attachable to a suspending element essentially above said center of gravity to suspend the elevator in said horizontal position.

4. The combination as recited in claim 1, including spring means yieldingly urging said slips radially inwardly.

5. The combination as recited in claim 1, in which said outer body has a shoulder at an outer end thereof engageable with an end of a tubular member to limit insertion of the elevator thereinto.

6. An internal elevator for lifting a tubular member comprising:

an outer body adapted to be received within said tubular member and having an essentially tubular side wall containing openings;

a plurality of slips mounted within openings in said sidewall of said body for movement radially inwardly and outwardly relative thereto and having radially outer gripping faces engageable outwardly against said tubular member to grip and support it;

an inner essentially tubular body within said outer body and movable axially relative thereto and having a connection adapted to be attached to a supporting element in a manner suspending said inner body therefrom;

said inner body having flaring radially outer camming surface areas engaging radially inner camming surfaces of said slips and acting upon axial movement of said inner body relative to the outer body and slips to cam said slips radially outwardly against the tubular member; and a piston and cylinder mechanism contained within said inner body and having its piston and cylinder connected at axially spaced locations to said outer body and said inner body respectively in a relation to actuate the inner body axially relative to the outer body and relative to said slips and to cam the slips radially outwardly against said tubular member.

7. An internal elevator as recited in claim 1, in which said outer body has an axially facing shoulder engageable with an end of said tubular member to limit movement of said elevator thereinto.

8. An internal elevator as recited in claim 6, including a tapering structure at an axially inner end of said outer body engageable with an end of said tubular member to center the outer body therein during stabbing of the elevator into the tubular member.

9. An internal elevator as recited in claim 6, in which said inner body has a generally transverse end wall at a first end thereof to which a first end of said piston and cylinder mechanism is attached, and said outer body has a generally transverse end portion beyond a second end of said inner body and to which a second end of said piston and cylinder mechanism is attached.

10. The combination comprising an internal elevator as recited in claim 6, and a hanger adapted to suspend the elevator in a horizontal position in which the elevator while suspended can be inserted in an axially inward direction into an end of said tubular member while the tubular member extends horizontally.

11. The combination comprising an internal elevator as recited in claim 6, and a hanger adapted to suspend the elevator in a horizontal position in which the elevator while suspended can be inserted in an axially inward direction into an end of said tubular member while the tubular member extends horizontally, said connection being constructed to suspend the elevator in a vertically extending position from a supporting element.

12. An internal elevator as recited in claim 6, including spring means yieldingly urging said slips radially inwardly.

13. The combination as recited in claim 6, including means for attaching elongated tubular elements to opposite ends of said outer body in positions of alignment with one another for facilitating insertion of said elevator in guided relation between spaced pile guides.

14. An internal elevator as recited in claim 6, including elongated tubular elements connected to opposite ends of said outer body and projecting in opposite directions therefrom in alignment with one another for facilitating insertion of said elevator through spaced pile guides.

15. An internal elevator as recited in claim 6, including tubular projections secured to opposite ends of said outer body and projecting in opposite directions therefrom and in alignment with one another and adapted to be secured to elongated aligned tubular parts for facilitating insertion of the elevator through spaced pile guides.

16. The method that comprises:

lowering through a plurality of spaced pile guides an elongated structure including an internal elevator to be received within and internally engage and support a pile and including a lower aligning pipe projecting downwardly from the elevator and an upper aligning pipe projecting upwardly from the elevator;

advancing said lower aligning pipe into a pile aligned with said guides;

advancing said internal elevator into said pile;

maintaining said elongated structure, after said lower aligning pipe reaches a second of said guides and during lowering therebeyond, continuously in engagement with at least two successive guides in a relation maintaining said structure continously aligned with the pile by simultaneous reception within more than one guide until the lower aligning pipe reaches and advances into said pile;

actuating said internal elevator against the pile after movement thereinto; and lifting the pile through said guides by said elevator.

* * * * *

UNITED STATES PATENT AND TRADEMARK OFFICE

CERTIFICATE OF CORRECTION

PATENT NO. : 4,320,915

DATED : March 23, 1982

INVENTOR(S) : Roderick K. Abbott, Padmasiri D. Seneviratne, Daniel P. Juhasz

It is certified that error appears in the above-identified patent and that said Letters Patent is hereby corrected as shown below:

Column 9, line 11, "1" should read -- 6 --.

Signed and Sealed this

First Day of November 1983

[SEAL]

*Attest:*

GERALD J. MOSSINGHOFF

*Attesting Officer*

*Commissioner of Patents and Trademarks*